US008878635B2

(12) United States Patent
Miyamoto et al.

(10) Patent No.: US 8,878,635 B2
(45) Date of Patent: Nov. 4, 2014

(54) TUNABLE BAND-PASS FILTER

(75) Inventors: Takahiro Miyamoto, Tokyo (JP); Sumio Ueda, Tokyo (JP)

(73) Assignee: NEC Corporation, Tokyo (JP)

( * ) Notice: Subject to any disclaimer, the term of this patent is extended or adjusted under 35 U.S.C. 154(b) by 327 days.

(21) Appl. No.: 13/378,631

(22) PCT Filed: Jun. 23, 2010

(86) PCT No.: PCT/JP2010/060638
§ 371 (c)(1),
(2), (4) Date: Dec. 15, 2011

(87) PCT Pub. No.: WO2010/150815
PCT Pub. Date: Dec. 29, 2010

(65) Prior Publication Data

US 2012/0126914 A1 May 24, 2012

(30) Foreign Application Priority Data

Jun. 23, 2009 (JP) ..... 2009-148168

(51) Int. Cl.
*H01P 1/20* (2006.01)
*H01P 1/207* (2006.01)

(52) U.S. Cl.
CPC ..... *H01P 1/207* (2013.01)
USPC ..... 333/209; 333/235; 333/212; 333/251

(58) Field of Classification Search
USPC ..... 333/209
See application file for complete search history.

(56) References Cited

U.S. PATENT DOCUMENTS

| | | | | |
|---|---|---|---|---|
| 4,761,625 | A | 8/1988 | Sharma | |
| 6,392,508 | B1 | 5/2002 | Damphousse et al. | |
| 2004/0017272 | A1 | 1/2004 | Smith et al. | |
| 2011/0187477 | A1 * | 8/2011 | Kunes | 333/132 |

FOREIGN PATENT DOCUMENTS

| | | | |
|---|---|---|---|
| GB | 2387718 | A | 10/2003 |
| JP | 2006121463 | A | 5/2006 |
| JP | 2007088545 | A | 4/2007 |
| JP | 2008295024 | A | 12/2008 |
| JP | 2009005333 | A | 1/2009 |
| WO | 2006075439 | A | 7/2006 |

OTHER PUBLICATIONS

Japanese Office Action for JP2009-148168 mailed on Oct. 4, 2012.
European search report for EP10792133.0 dated Oct. 17, 2012.
International Search Report for PCT/JP2010/060638 mailed Oct. 5, 2010.
Chinese Office Action for CN Application No. 201080027936.3 issued on Jan. 17, 2014 with English Translation.

* cited by examiner

*Primary Examiner* — Robert Pascal
*Assistant Examiner* — Kimberly Glenn
(74) *Attorney, Agent, or Firm* — Sughrue Mion, PLLC

(57) ABSTRACT

A tunable band-pass filter includes: a rectangular waveguide including a first and a second waveguide parts, which are acquired by dividing the rectangular waveguide along an E-plane of the rectangular waveguide at a center position of an H-plane in the rectangular waveguide; a metal plate sandwiched by the first and the second waveguide parts in such a way as to be parallel to the E-plane; at least one dielectric plate arranged in the rectangular waveguide in such a way as to extend in a longitudinal extension direction of the metal plate; and a drive mechanism changing a relative position relationship between the dielectric plate and the metal plate from the outside.

10 Claims, 5 Drawing Sheets

$\theta$ =0°

$\theta$ =45°

$\theta$ =90°

TUNABLE BAND-PASS FILTER

CROSS-REFERENCE TO RELATED APPLICATION

This application is a continuation of International Application No. PCT/JP2010/060638, filed on Jun. 23, 2010. The disclosure of the PCT application, in its entirety, including the drawings, claims, and the specification thereof, is incorporated herein by reference.

TECHNICAL FIELD

The present invention relates to a tunable band-pass filter, and, in particular, to a tunable band-pass filter designed for high frequency and capable of shifting a pass frequency band by using dielectric.

BACKGROUND ART

As a band-pass filter used over a wide frequency range from a micro-wave band to a millimeter-wave band, there has been known a waveguide filter using a waveguide. The waveguide filter is low in loss and is high in power durability and is widely employed in a communication device mounted in an artificial satellite and a communication device in a ground station and the like.

As one type of the waveguide filter, JP-2006-121463-A discloses a waveguide filter in which a rectangular waveguide is divided into two parts at a center position of an H-plane thereof and along a direction in which an electromagnetic wave propagates in the waveguide by a plane vertical to the H-plane, that is, an E-plane, and in which a thin metal plate arranged parallel to the E-plane of the waveguide is sandwiched by the two divided parts and in which a dielectric plate is arranged on at least one portion above or below the metal plate. The dielectric plate is arranged so as to be parallel to the E-plane of the waveguide in such a way as to extend in a longitudinal extension direction of the metal plate. A dielectric material having a relative permittivity of 1.0 or more is used as the dielectric plate. The metal plate is designed in the shape of a ladder in such a way as to have a pass band at a specified frequency. In other words, the metal plate has windows periodically formed therein along the propagation direction of the electromagnetic wave. The loading of the dielectric plate produces an effect of changing an electric length in the direction of the H-plane. Thus, when the thickness and the arrangement position of the dielectric plate are changed, the center frequency of the waveguide filter can be changed, that is, a frequency shift of the center frequency can be achieved with a pass bandwidth held almost constant.

However, in the band-pass filter disclosed in JP-2006-121463-A, the shape of the metal plate or the dielectric plate constructs a coupling coefficient necessary for the band-pass filter, so that in order to change the center frequency, the metal plate or the dielectric plate that constructs the filter needs to be replaced by an other metal plate or dielectric plate. In other words, the band-pass filter disclosed in JP-2006-121463-A cannot be used as a tunable filter capable of changing the center frequency of a pass band during an operation.

In WO2006/075439 is disclosed a band-pass filter that uses a semi-coaxial cavity resonator and that can change a center frequency from the outside without putting a hand into the filter, or is tunable. In this tunable filter, an outer conductive part has a plurality of separate cavity portions formed therein, the cavity portions constructing respective stages of the resonator. The adjacent cavity portions are electromagnetically coupled to each other. The degree of electromagnetic coupling between the adjacent cavity portions can be adjusted by a coupling adjustment screw. Each of the cavity portions has an inner conductive part and a frequency adjustment screw provided therein as well as a dielectric member movably inserted therein, the dielectric member being fixed to a holding member. The holding member is projected to the outside of the outer conductive part. The outer conductive part has a link member provided on the outside thereof, the link member being common to the respective cavity portions. The holding member of each cavity portion is coupled to this link member. When the link member is slid or rotated, the distance between the dielectric member and the inner conductive part is changed in each cavity portion and hence the resonance frequency of each cavity portion as a resonator can be changed concurrently.

However, in order to realize excellent pass band characteristics in this tunable filter, the filter needs to be adjusted for each resonator of each stage by using the frequency adjustment screw and the coupling adjustment screw. Thus, in the case where the resonator has a large number of stages, this adjustment becomes extremely troublesome. Further, in order to realize a frequency shift, many parts such as the holding member, the link member, the dielectric member, and the drive unit need to be prepared.

SUMMARY OF INVENTION

Technical Problem

An exemplary object of the present is to provide a tunable band-pass filter constructed as a waveguide filter and having a simple structure.

Solution to Problem

A tunable band-pass filter according to an exemplary aspect of the present invention includes: a rectangular waveguide including a first and a second waveguide parts, which are acquired by dividing the rectangular waveguide along an E-plane of the rectangular waveguide at a central position of an H-plane in the rectangular waveguide; a metal plate sandwiched by the first and the second waveguide parts in such a way as to be parallel to the E-plane; at least one dielectric plate arranged in the rectangular waveguide in such a way as to extend in a longitudinal extension direction of the metal plate; and a drive mechanism changing a relative position relationship between the dielectric plate and the metal plate from the outside.

In such a tunable band-pass filter, the dielectric plate that makes an effect on the resonator's electromagnetic field distribution, which is designed in advance, to thereby change the resonance frequency is arranged over the whole of the waveguide filter and is connected to the outside drive mechanism in such a way that the outside drive mechanism can integrally move the dielectric plate from the outside, whereby the dielectric plate can have its position or angle changed. In this way, in the tunable band-pass filter, the center frequency of a pass band can be changed arbitrarily and continuously by a simple structure.

EXEMPLARY EMBODIMENTS

A tunable band-pass filter based on the present invention is constructed as a waveguide filter using a rectangular waveguide. One example of the construction of the tunable band-pass filter is as follows: a rectangular waveguide is divided into two waveguide parts along an E-plane at a center position of an H-plane as a waveguide; a filter element made of a thin metal plate and designed so as to resonate at a specified frequency is sandwiched by the two waveguide parts; and a movable dielectric plate is provided.

In order to make the metal plate function as the filter element, the metal plate has, for example, a plurality of windows formed therein, whereby the metal plate is formed in the shape of a ladder.

The dielectric plate is constructed of dielectric part having a relative permittivity of 1 or more. As an example of the construction, the dielectric plate is arranged close to the metal plate in such a way as to elongate in a longitudinal extension direction of the metal plate, that is, in a direction in which an electromagnetic wave propagates in the rectangular waveguide. A support rod connected to the dielectric plate is projected to the outside of the rectangular waveguide, and the relative position relationship between the dielectric plate and the metal plate can be changed from the outside by operating the support rod. As a result, the length of the H-plane of the waveguide can be electrically changed by use of the effect of wavelength shortening by a dielectric constant, whereby a shift of a center frequency as a filter can be realized. For example, the dielectric plate can be constructed in the following manner: the support rod is arranged in such a way as to extend along a portion in which the metal plate is joined to the rectangular waveguide and the long side of the dielectric plate is joined to the support rod, whereby the dielectric plate can perform a flap motion to the metal plate.

Here, the H-plane is a plane that is a wide plane in the rectangular waveguide when the section of the rectangular waveguide is considered at a plane vertical to the propagation direction of the electromagnetic wave. In an example shown in FIG. 1, the H-plane is a vertical plane. Similarly, the E-plane corresponds to a plane that is a narrow plane in the rectangular waveguide. In the example shown in FIG. 1, the E-plane is a horizontal plane.

Figure 1:
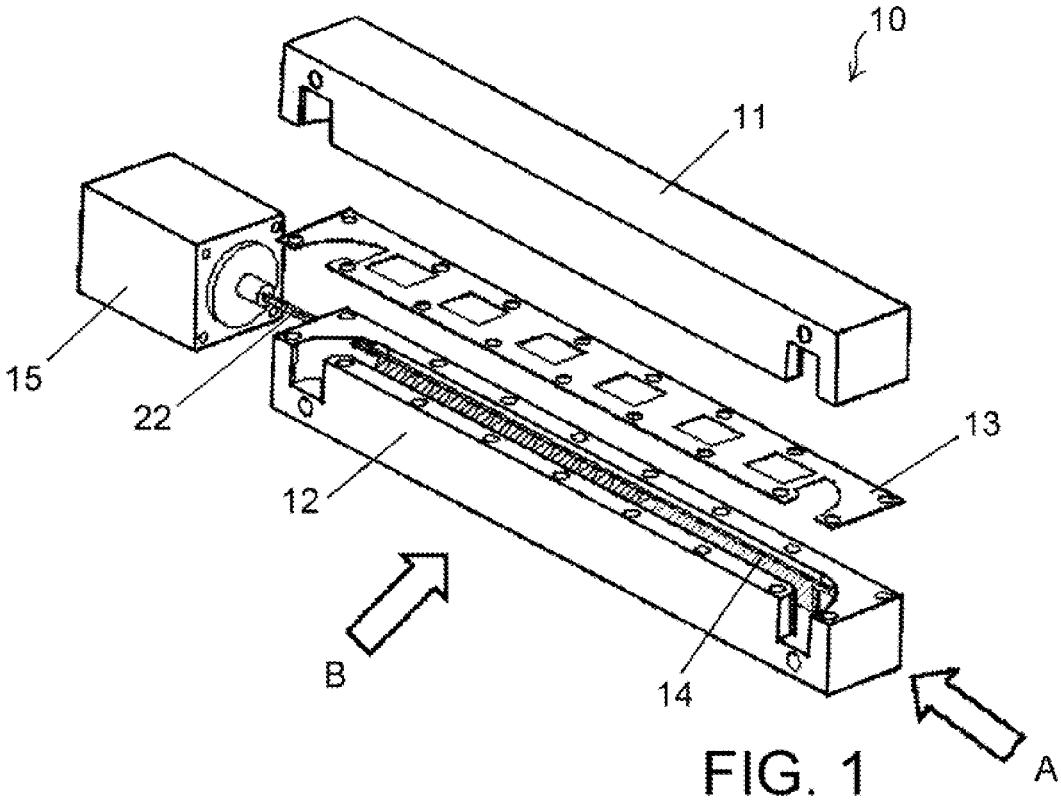
FIG. 1 is an exploded perspective view of a tunable band-pass filter according to a first exemplary embodiment.
Figure 2:
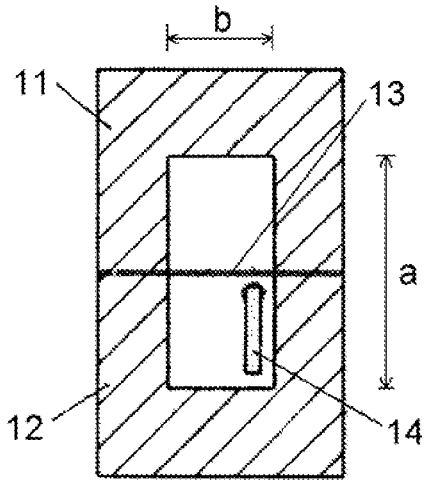
FIG. 2 is a section view when viewed from a direction shown by an arrow A in FIG. 1.
Figure 3:
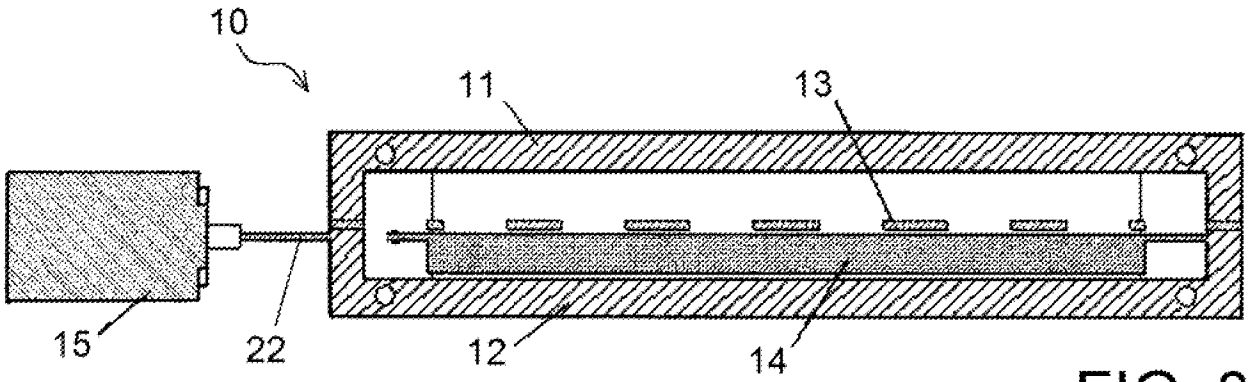
FIG. 3 is a section view when viewed from a direction shown by an arrow B in FIG. 1.

FIG. 1, FIG. 2, and FIG. 3 show the structure of tunable band-pass filter 10 according to a first exemplary embodiment.

The rectangular waveguide is divided into two waveguide parts 11, 12 along the E-plane at the center position of the H-plane as the rectangular waveguide. Thin metal plate 13 constructed as a filter element is sandwiched by two waveguide parts 11, 12. Metal plate 13 is designed so as to resonate at a specified frequency. In the example shown in FIG. 1, metal plate 13 has six windows formed therein, whereby metal plate 13 is formed in the shape of a ladder.

The windows of metal plate 13 are arranged at, for example, regular intervals along the axial direction of the rectangular waveguide, that is, the propagation direction of the electromagnetic wave. In this structure, when tunable band-pass filter 10 is viewed as a whole, metal plate 13 having a plurality of windows formed therein is arranged as the filter element in parallel to the E-plane at the center position in the H-plane in the rectangular waveguide. Thus, this filter is constructed as a tunable E-plane band-pass filter.

Plate-shaped dielectric plate 14 is arranged on one side of the metal plate in the inner wall of waveguide part 12 and along the longitudinal extension direction of metal plate 13, that is, the propagation direction of the electromagnetic wave. It is essential only that the length of dielectric plate 14 is longer than, for example, a length from a first stage to a final stage of metal plate 13 constructing the filter element.

Dielectric plate 14 is formed in the shape a flag that is combined with a pole and that is high in length. A portion at the root of the pole is projected as support rod 22 to the outside of the rectangular waveguide and is made a link portion connected to drive unit 15. Drive unit 15 can apply a flap motion or a parallel movement to dielectric plate 14, the flap motion being made around the pole, the parallel movement being made along the propagation direction of the electromagnetic wave. A stepping motor, for example, can be used as drive unit 15.

A drive mechanism for dielectric plate 14 is constructed of drive unit such as the stepping motor and support rod 22.

The relative permittivity of dielectric plate 14 is 1 or more, and dielectric plate 14 constructs a band-pass filter in cooperation with metal plate 13. This tunable band-pass filter employs a mode $TE_{10s}$ (s=1, 2, 3, . . . ) that is one of propagation modes of the rectangular waveguide, so that a resonance frequency is determined by a length in the direction of the H-plane and a length in the propagation direction of the electromagnetic wave. Thus, by inserting dielectric plate 14 into the rectangular waveguide and by changing the angle formed by dielectric plate 14 and metal plate 13 as the filter element, an electric length in the direction of the H-plane is made variable to thereby vary a resonance frequency. In other words, dielectric plate 14 makes an effect on the electromagnetic field distribution of each resonator to thereby change the resonance frequency.

A specific example will be described below. Let's consider a six-stage tunable band-pass filter using a rectangular waveguide (a×b=15.8 mm×7.9 mm) of a band of 15 GHz, where a is the length of the H-plane and b is the length of the E-plane. Plate-shaped dielectric plate 14 is arranged in the tunable band-pass filter shown in FIG. 1. The relative permittivity of dielectric plate 14 is assumed to be, for example, 2.6. This dielectric plate 14 is used for shifting a frequency, and the relative permittivity of dielectric plate 14 only need to be determined according to the characteristics to be acquired.

Dielectric plate 14 can vary the angle formed by dielectric plate 14 and the H-plane from 0° to 90° by the flap motion made by drive unit 15. This variation will be shown in FIG.

Figure 4A:
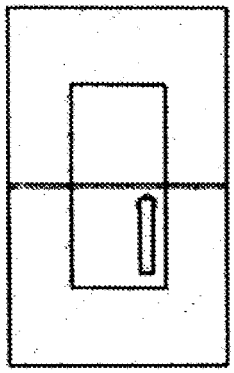
FIG. 4A is a section view to illustrate a flap motion of a dielectric plate.
Figure 4B:
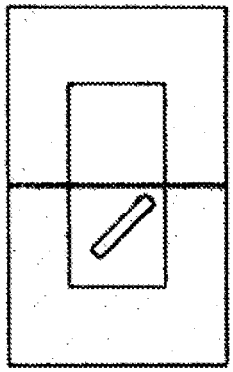
FIG. 4B is a section view to illustrate the flap motion of the dielectric plate.
Figure 4C:
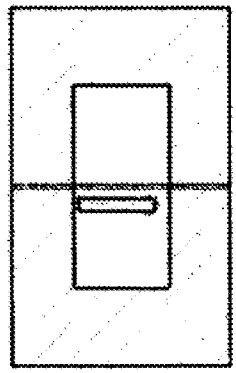
FIG. 4C is a section view to illustrate the flap motion of the dielectric plate.
Figure 5:
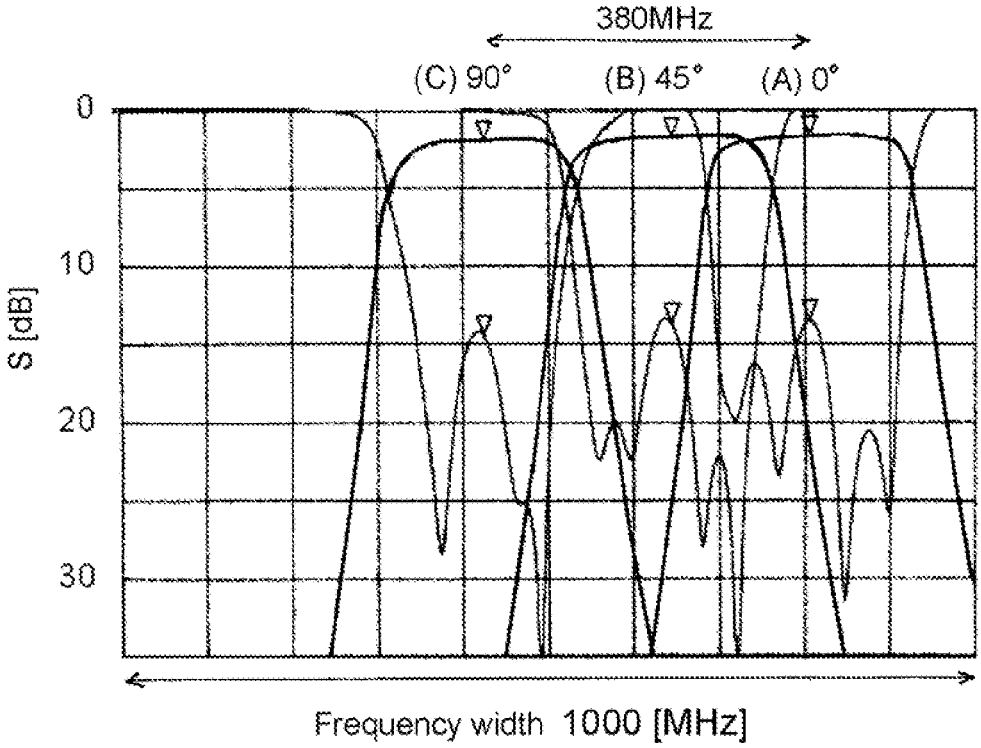
FIG. 5 is a graph to exemplarily show a measurement result of pass characteristics of a band-pass filter associated with a flap motion of a dielectric plate.

4A, FIG. 4B, and FIG. 4C which are section views when viewed from the direction shown by an arrow A in FIG. 1. As a result, as shown in a measurement result in FIG. 5, a frequency shift of 380 MHz can be realized with a pass bandwidth almost unchanged.

In this tunable band-pass filter, an electromagnetic field is most concentrated near metal plate 13. When dielectric plate 14 is brought closer to metal plate 13, the effect of wavelength shortening that is produced by dielectric plate 14 is more intensively developed, so that dielectric plate 14 acts in such a way that the wide plane of the rectangular waveguide is apparently made electrically larger. In other words, as the position of dielectric plate 14 is moved from θ=0° (the case of FIG. 4A) to θ=45° (the case of FIG. 4B) and further to 9=90° (the case of FIG. 4C), dielectric plate 14 is brought closer to metal plate 13 and a resonance frequency is shifted to a lower frequency. Curves (A), (B), and (C) in FIG. 5 correspond respectively to cases where the relationships between dielectric plate 14 and metal plate 13 are in the states shown in FIG. 4A, FIG. 4B, and FIG. 4C, respectively.

By the flap motion of dielectric plate 14, a motion to make an H-plane wider and a motion to make a center frequency shift to a lower frequency cancel each other out in the coupling coefficient of the filter, so that in this tunable band-pass filter, the center frequency is shifted with a variation in pass bandwidth held little. Furthermore, when the material (that is, relative permittivity) of dielectric plate 14 is changed or dielectric plates 14 are arranged in plural numbers, a variation in the center frequency can be made larger. In this regard, in place of the flap motion of dielectric plate 14, dielectric plate 14 may be translated in such a way that the distance between dielectric plate 14 and metal plate 13 is changed.

This tunable band-pass filter has a simple construction made of waveguide parts 11, 12 and movable dielectric plate 14 and hence can be easily manufactured. Further, when support rod 22 of dielectric plate 14 which is projected to the outside of waveguide parts 11, 12 is connected to drive unit 15 and the flap motion or the translating motion is applied to dielectric plate 14, a variation in the frequency can be realized arbitrarily and continuously.

Figure 6:
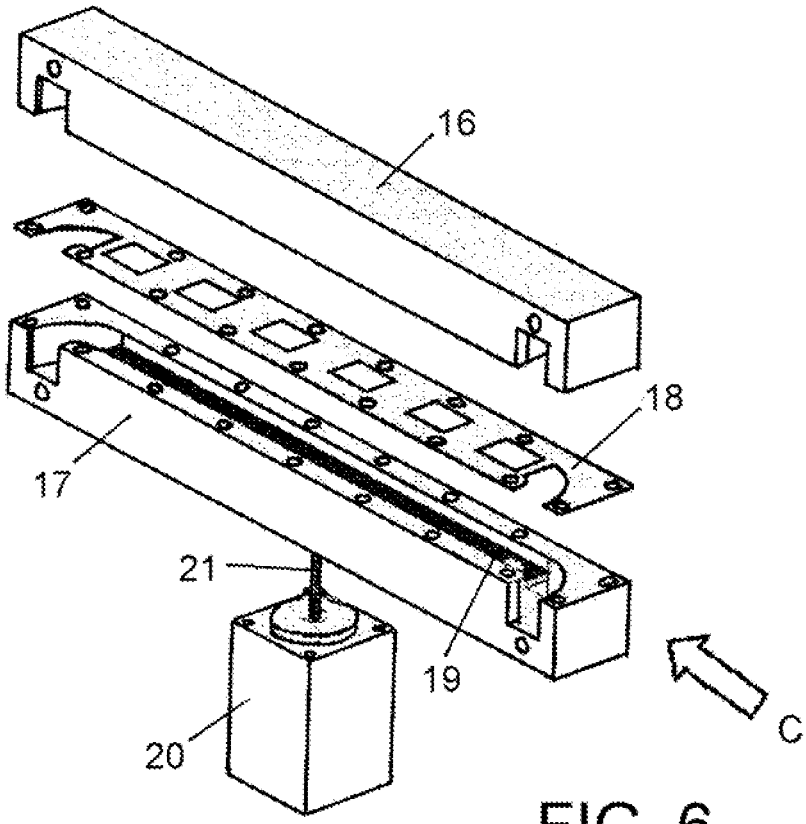
FIG. 6 is an exploded perspective view of a tunable band-pass filter according to a second exemplary embodiment.
Figure 7:
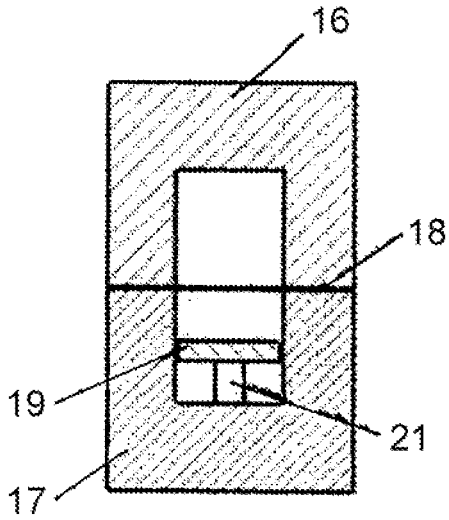
FIG. 7 is a section view when viewed from a direction shown by an arrow C in FIG. 6.

FIG. 6 and FIG. 7 show the structure of a tunable band-pass filter according to a second exemplary embodiment.

A rectangular waveguide is divided into two waveguide parts 16, 17 along the E-plane at the center position of the H-plane as the rectangular waveguide. Thin metal plate 18 constructed as a filter element is sandwiched by two waveguide parts 16, 17. Metal plate 18 is designed in such a way as to resonate at a specified frequency. In metal plate 18 shown in FIG. 6, metal plate 18 has six windows formed therein, whereby metal plate 18 is formed in the shape of a ladder.

A plate-shaped dielectric plate 19 is arranged parallel to the E-plane in waveguide part 17. Dielectric plate 19 is connected to drive unit 20 via a support rod 21 at its center portion. When dielectric plate 19 is moved up and down in the drawing by drive unit 20, the length of the wide plane of the rectangular waveguide can be electrically changed and hence a center frequency can be changed. In this regard, dielectric plate 19 may be arranged above metal plate 18 in the drawing, that is, in waveguide part 16.

As drive unit 20 can be used an assembly having, for example, a stepping motor and a mechanism for converting a rotational motion made by the stepping motor to a straight motion. A drive mechanism for dielectric plate 19 is constructed of drive unit 20 and support rod 21.

In this construction, when dielectric plate 19 is moved up and down in the drawing by drive unit 20, the distance between dielectric plate 19 and metal plate 18 is changed, whereby an electric length in the direction of the H-plane in the rectangular waveguide is also changed. It is only necessary that the length of dielectric plate 19 in the axial direction of the waveguide is longer than, for example, a length from the first stage to the final stage of metal plate 18 constructing the filter element.

Figure 8:
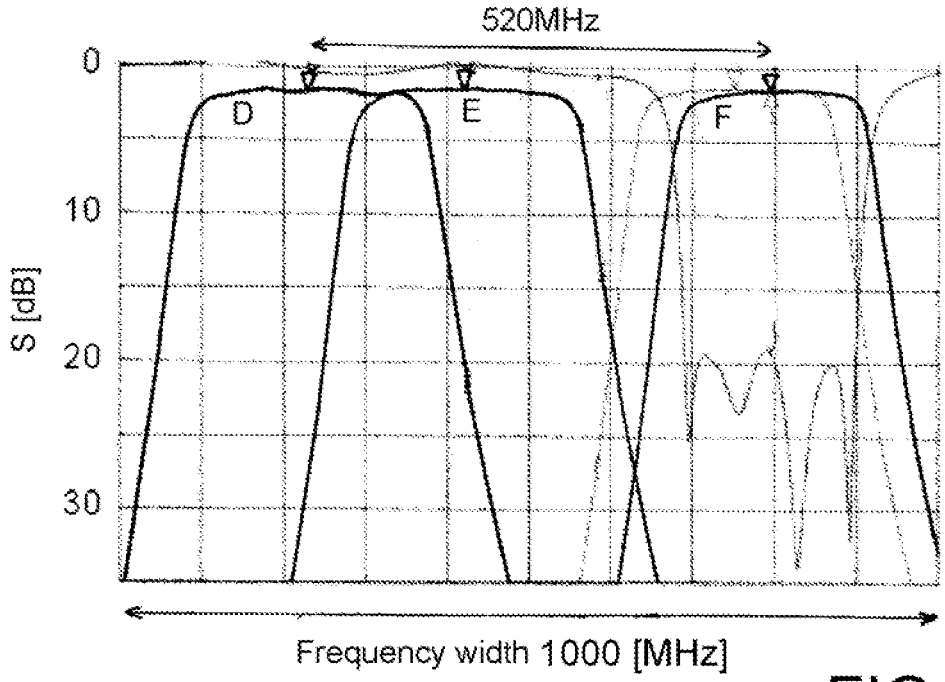
FIG. 8 is a graph to exemplarily show a measurement result of pass characteristics of a band-pass filter associated with an up-and-down motion of a dielectric plate.

The measurement result of pass characteristics of the tunable band-pass filter of the second exemplary embodiment will be shown in FIG. 8. In FIG. 8, a frequency shift of 520 MHz is realized by moving dielectric plate 19 having a relative permittivity of 2.6, which is arranged on a six-stage E-plane filter. An electromagnetic field is most intensive near metal plate 18, so that when dielectric plate 19 is brought closer to metal plate 18, the center frequency is shifted to a lower frequency as shown by curve D and, on the contrary, when dielectric plate 19 is brought away from metal plate 18, the center frequency is shifted to a higher frequency as shown by curve F. Curve E shows a pass band in the case where dielectric plate 19 is at an intermediate position.

Figure 9:
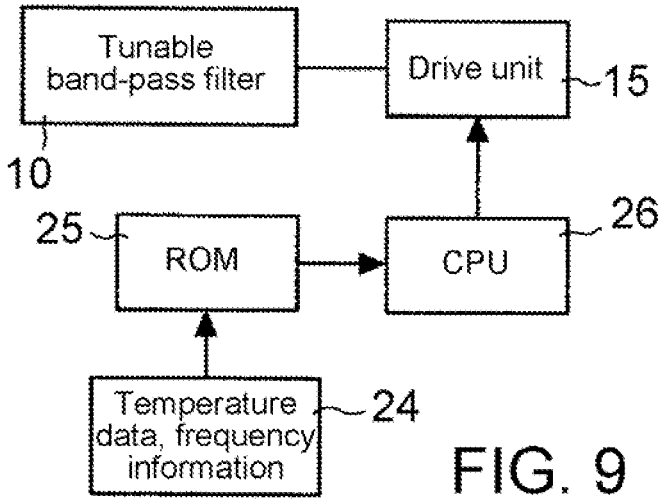
FIG. 9 is a block diagram to show an example of the construction of a tunable band-pass filter having a temperature compensation function.

A tunable band-pass filter according to a third exemplary embodiment is a combination of the tunable band-pass filter of the first exemplary embodiment and the tunable band-pass filter of the second exemplary embodiment. A tunable band-pass filter having a larger amount of frequency shift can be realized by arbitrarily combining the first exemplary embodiment and the second exemplary embodiment FIG. 9 shows a tunable band-pass filter according to a fourth exemplary embodiment, that is, one example of the construction of a tunable band-pass filter having a temperature compensation function. The flap motion of dielectric plate 14 by drive unit 15 in the first exemplary embodiment or the up-and-down motion of dielectric plate 19 by drive unit 20 in the second exemplary embodiment can be performed by a computer control. Thus, assuming that tunable band-pass filter 10 described in the first exemplary embodiment is used in the case, for example, where a dielectric member for compensating thermal expansion or contraction of the metal plate caused by the material characteristics of the metal plate is provided, temperature data and frequency information 24 are collected and are inputted to read-only memory (ROM) 25 in which data for compensation data is stored. Upon output of the data from ROM 25, central processing unit (CPU) 26 transmits a control signal to drive unit 15 and drive unit 15 applies a flap motion to dielectric plate 14 in response to the control signal.

Furthermore, the tunable band-pass filter based on the present invention includes filters having constructions described in the following Supplementary notes, but is not limited to them.

<Supplementary Note 1>

A tunable band-pass filter characterized by including:

a thin metal plate sandwiched in parallel to an E-plane by a rectangular waveguide which is divided into two parts at the center of an H-plane;

a dielectric plate arranged in at least one position below or above the metal plate in such a way as to extend in a longitudinal extension direction of the metal plate and having a relative permittivity of 1.0 or more; and a drive unit changing a relative position relationship between the dielectric plate and the metal plate from the outside.

<Supplementary Note 2>

The tunable band-pass filter as described in Supplementary note 1, wherein the dielectric plate is arranged parallel to the H-plane and the drive unit makes the dielectric plate flap around a portion near the metal plate to thereby change a relative angle between the dielectric plate and the metal plate.

<Supplementary Note 3>

The tunable band-pass filter as described in Supplementary note 1, wherein the dielectric plate is arranged parallel to the H-plane and the drive unit translates the dielectric plate in the longitudinal extension direction of the metal plate to thereby change a relative overlap relationship between the dielectric plate and the metal plate.

<Supplementary Note 4>

The tunable band-pass filter as described in Supplementary note 1, wherein the dielectric plate is arranged parallel to the E-plane and the drive unit moves the dielectric plate vertically up and down with respect to the metal plate to thereby change a distance between the dielectric plate and the metal plate.

<Supplementary Note 5>

The tunable band-pass filter as described in any one of Supplementary notes 1 to 4, wherein a stepping motor is used for the drive unit.

<Supplementary Note 6>

The tunable band-pass filter as described in any one of Supplementary notes 1 to 5, wherein the drive unit is controlled by a computer on the basis of specified information to thereby change a relative position relationship between the dielectric plate and the metal plate.

Up to this point, the present invention has been described with reference to the exemplary embodiments, but the present invention is not limited to the exemplary embodiments described above. Various modifications to be understood by a person skilled in the art can be made to the construction and the detail of the present invention within the scope of the present invention.

This application is based upon and claims the benefit of priority from Japanese Patent Application No. 2009-148168, filed on Jun. 23, 2009, the disclosure of which is incorporated herein in its entirety by reference.

Reference Sings List

10 Tunable band-pass filter;
11, 12, 16, 17 Waveguide portion;
13, 18 Metal plate;
14, 19 Dielectric plate;
15, 20 Drive unit;
21, 22 Support rod;
24 Temperature data, frequency information;
25 ROM;
26 CPU.

CITATION LIST

Patent Literatures

PL1: JP-2006-121463-A
PL2: WO2006-075439

What is claimed is:

1. A tunable band-pass filter comprising:

a rectangular waveguide including a first waveguide part and a second waveguide part, which are acquired by dividing the rectangular waveguide along an E-plane of the rectangular waveguide at a center position of an H-plane in the rectangular waveguide;

a metal plate sandwiched by the first waveguide part and the second waveguide part in such a way as to be parallel to the E-plane;

at least one dielectric plate arranged in the rectangular waveguide in such a way as to extend along a longitudinal extension direction of the metal plate; and a drive mechanism changing a relative positional relationship between the dielectric plate and the metal plate from an outside, wherein the dielectric plate is arranged parallel to the H-plane, and wherein the drive mechanism flaps the dielectric plate around a portion near the metal plate to thereby change a relative angle formed by the dielectric plate and the metal plate.

2. The tunable band-pass filter according to claim 1, wherein the metal plate has one window or a plurality of windows formed along an axial direction of the rectangular waveguide and is constructed as a filter element.

3. The tunable band-pass filter according to claim 1, wherein the metal plate has a plurality of windows formed along an axial direction of the rectangular waveguide and is constructed as a filter element, and wherein a length of the dielectric plate along an axial direction of the rectangular waveguide is longer than a length of an area in which the plurality of windows are formed.

4. The tunable band-pass filter according to claim 1, wherein the drive mechanism includes a stepping motor driving the dielectric plate.

5. The tunable band-pass filter according to claim 1, wherein the drive mechanism is controlled by a computer based on specified information to thereby change a relative positional relationship between the dielectric plate and the metal plate.

6. A tunable band-pass filter comprising:

a rectangular waveguide including a first waveguide part and a second waveguide part, which are acquired by dividing the rectangular waveguide along an E-plane of the rectangular waveguide at a center position of an H-plane in the rectangular waveguide;

a metal plate sandwiched by the first waveguide part and the second waveguide part in such a way as to be parallel to the E-plane;

at least one dielectric plate arranged in the rectangular waveguide in such a way as to extend along a longitudinal extension direction of the metal plate; and a drive mechanism changing a relative positional relationship between the dielectric plate and the metal plate from an outside, wherein the dielectric plate is arranged parallel to the H-plane, and wherein the drive mechanism translates the dielectric plate in the longitudinal extension direction of the metal plate to thereby change a relative overlap relationship between the dielectric plate and the metal plate.

7. The tunable band-pass filter according to claim 6, wherein the drive mechanism includes a stepping motor driving the dielectric plate.

8. The tunable band-pass filter according to claim 6, wherein the drive mechanism is controlled by a computer based on specified information to thereby change a relative positional relationship between the dielectric plate and the metal plate.

9. The tunable band-pass filter according to claim 6, wherein the metal plate has one window or a plurality of windows formed along an axial direction of the rectangular waveguide and is constructed as a filter element.

10. The tunable band-pass filter according to claim 6, wherein the metal plate has a plurality of windows formed along an axial direction of the rectangular waveguide and is constructed as a filter element, and wherein a length of the dielectric plate along an axial direction of the rectangular waveguide is longer than a length of an area in which the plurality of windows are formed.

* * * * *